US007278820B2

(12) United States Patent
Keller

(10) Patent No.: US 7,278,820 B2
(45) Date of Patent: Oct. 9, 2007

(54) RING SEAL SYSTEM WITH REDUCED COOLING REQUIREMENTS

(75) Inventor: Douglas A. Keller, Oviedo, FL (US)

(73) Assignee: Siemens Power Generation, Inc., Orlando, FL (US)

( * ) Notice: Subject to any disclaimer, the term of this patent is extended or adjusted under 35 U.S.C. 154(b) by 85 days.

(21) Appl. No.: 11/243,146

(22) Filed: Oct. 4, 2005

(65) Prior Publication Data

US 2007/0077141 A1 Apr. 5, 2007

(51) Int. Cl.
*F01D 9/00* (2006.01)

(52) U.S. Cl. ..... 415/173.1; 415/213.1; 415/177

(58) Field of Classification Search ..... 415/173.1, 415/177, 213.1
See application file for complete search history.

(56) References Cited

U.S. PATENT DOCUMENTS

| | | | | |
|---|---|---|---|---|
| 3,966,356 | A | 6/1976 | Irwin | |
| 3,986,720 | A | 10/1976 | Knudsen et al. | |
| 4,527,385 | A | 7/1985 | Jumelle et al. | |
| 4,551,064 | A | 11/1985 | Pask | |
| 4,566,851 | A | 1/1986 | Comeau et al. | |
| 4,702,672 | A | 10/1987 | Leicht et al. | |
| 4,728,257 | A | 3/1988 | Handschuh | |
| 4,759,687 | A | 7/1988 | Miraucourt et al. | |
| 5,271,220 | A | 12/1993 | Holmes et al. | |
| 5,332,358 | A | 7/1994 | Hemmelgarn et al. | |
| 5,441,383 | A | 8/1995 | Dale et al. | |
| 5,988,975 | A * | 11/1999 | Pizzi | 415/139 |
| 6,200,091 | B1 | 3/2001 | Bromann et al. | |
| 6,302,642 | B1 | 10/2001 | Nagler et al. | |
| 6,315,519 | B1 | 11/2001 | Bagepalli et al. | |
| 6,354,795 | B1 * | 3/2002 | White et al. | 415/116 |
| 6,726,448 | B2 | 4/2004 | McGrath et al. | |
| 6,758,653 | B2 * | 7/2004 | Morrison | 415/173.4 |
| 6,821,085 | B2 * | 11/2004 | Darkins et al. | 415/173.1 |
| 7,044,709 | B2 * | 5/2006 | Bruce et al. | 415/173.1 |
| 7,117,983 | B2 * | 10/2006 | Good et al. | 188/380 |

* cited by examiner

*Primary Examiner*—Ninh H. Nguyen

(57) ABSTRACT

Aspects of the invention are directed to systems for reducing the cooling requirements of a ring seal in a turbine engine. In one embodiment, the ring seal can be made of a ceramic material, such as a ceramic matrix composite. The ceramic ring seal can be connected to metal isolation rings by a plurality of pins. The hot gas face of the ring seal can be coated with a thermal insulating material. In another embodiment, the ring seal can be made of metal, but it can be operatively associated with a ceramic heat shield. The metal ring seal can carry the mechanical loads imposed during engine operation, and the heat shield can carry the thermal loads. By minimizing the amount of ring seal cooling, the ring seal systems according to aspects of the invention can result in improved engine performance and emissions.

16 Claims, 10 Drawing Sheets

RING SEAL SYSTEM WITH REDUCED COOLING REQUIREMENTS

FIELD OF THE INVENTION

Aspects of the invention relate in general to turbine engines and, more particularly, to ring seals in the turbine section of a turbine engine.

BACKGROUND OF THE INVENTION

FIG. 1 shows an example of one known turbine engine 10 having a compressor section 12, a combustor section 14 and a turbine section 16. In the turbine section 16 of a turbine engine, there are alternating rows of stationary airfoils 18 (commonly referred to as vanes) and rotating airfoils 20 (commonly referred to as blades). Each row of blades 20 is formed by a plurality of airfoils 20 attached to a disc 22 provided on a rotor 24. The blades 20 can extend radially outward from the discs 22 and terminate in a region known as the blade tip 26. Each row of vanes 18 is formed by attaching a plurality of vanes 18 to a vane carrier 28. The vanes 18 can extend radially inward from the inner peripheral surface 30 of the vane carrier 28. The vane carrier 28 is attached to an outer casing 32, which encloses the turbine section 16 of the engine 10.

Between the rows of vanes 18, a ring seal 34 can be attached to the inner peripheral surface 30 of the vane carrier 28. The ring seal 34 acts as a hot gas path guide between the rows of vanes 18 at the locations of the rotating blades 20. The ring seal 34 is commonly formed by a plurality of metal ring segments. The ring segments can be attached either directly to the vane carrier 28 or indirectly such as by attaching to metal isolation rings (not shown) which attach to the vane carrier 28. Each ring seal 34 can substantially surround a row of blades 20 such that the tips 26 of the rotating blades 20 are in close proximity to the ring seal 34.

In operation, hot gases from the combustor section 14 are routed to the turbine section 16. The gases flow through the rows of vanes 18 and blades 20 in the turbine section 16. The ring seals 34 are exposed to the hot gases as well. In many engine designs, demands to improve engine performance have been met in part by increasing engine firing temperatures. Consequently, the ring seals 34 require greater cooling to keep the temperature of the ring seals 34 within the critical metal temperature limit. In the past, the ring seals 34 have been coated with thermal barrier coatings to minimize the amount of cooling required. However, even with a thermal barrier coating, the ring seal 34 must still be actively cooled using complicated and costly cooling systems. Further, the use of greater amounts of air to cool the ring seals 34 detracts from the use of air for other purposes in the engine. Thus, there is a need for a system that can minimize ring seal cooling requirements.

SUMMARY OF THE INVENTION

Aspects of the invention are directed to a ring seal system. The system includes a vane carrier that has an inner peripheral surface, forward and aft isolation rings, and a ceramic ring seal enclosed within the vane carrier. The aft isolation ring is spaced axially downstream of the forward isolation ring. The isolation rings are attached to the vane carrier such that the isolation rings extend substantially circumferentially about and substantially radially inward from the inner peripheral surface of the vane carrier.

The ring seal is operatively connected to the forward and aft isolation rings by a plurality of elongated fasteners, which can be, for example, pins. Such an arrangement can permit differential thermal growth between the isolation rings and the ring seal. At least a portion of the gas path face of the ring seal can be coated with a thermal insulating material. In one embodiment, the ring seal can have a forward span, an aft span and an axial extension connecting therebewteen.

A plurality of pins can be affixed to the forward isolation ring and extend substantially axially therefrom. The forward span of the ring seal can include a plurality of cutouts. Each cutout can receive a respective one of the plurality of pins.

The aft span of the ring seal can be adapted to substantially matingly engage the aft isolation ring. Accordingly, at least a portion of the aft span and the aft isolation ring can be coated with a wear resistant material.

In one embodiment, the ring seal can be positioned such that the forward span is located axially downstream of at least a portion of the forward isolation ring, and such that the aft span is located axially upstream of the aft isolation ring. In such case, the aft span and the axial extension can be angled at less than 90 degrees relative to each other. A plurality of pins can be removably attached to the aft isolation ring and extend substantially axially therefrom. The aft span of the ring seal can include a plurality of cutouts. Each cutout can receive a respective one of the plurality of pins.

In another embodiment, the ring seal can be positioned such that the forward span is located axially downstream of at least a portion of the forward isolation ring, and such that the aft span is located axially downstream of at least a portion of the aft isolation ring. The aft span and the axial extension can be angled at about 90 degrees relative to each other. A plurality of pins can be removably attached to the aft isolation ring and extend substantially axially therefrom. The aft span of the ring seal can include a plurality of cutouts. Each cutout can receive a respective one of the plurality of pins.

In another respect, aspects of the invention are directed to a ring seal system. The system includes a metal ring seal and a ceramic heat shield. The metal ring seal has an axial upstream face and an axial downstream face. The ceramic heat shield has a forward span and an aft span. The forward span is operatively connected to the axial upstream face of the ring seal by a plurality of fasteners. Likewise, the aft span is operatively connected to the axial downstream face of the ring seal by a plurality of fasteners. The fasteners can extend through cutouts provided in the heat shield and into engagement with the ring seal. The heat shield is spaced from the ring seal so that a space is defined therebetween. In one embodiment, the heat shield can be positioned such that the forward span is axially upstream of the axial upstream face of the ring seal and such that the aft span is axially downstream of the axial downstream face.

The system can provide sealing at various locations. For instance, a first gap can be defined between the axial upstream face of the ring seal and the forward span of the heat shield. A second gap can be defined between the axial downstream face of the ring seal and the aft span of the heat shield. The system can further include one or more seal plates that can be attached to the ring seal so as to at least partially obstruct fluid communication with the space through the first and second gaps. As a result, fluid leakage through the gaps can be minimized.

Seals can also be associated with the circumferential ends of the ring seal. To that end, a recess can be included in one of the opposite circumferential ends of the ring seal. A portion of a side seal can be received within the recess.

The ring seal system can include a number of cooling-related features. For instance, there can be a plurality of cooling supply holes extending through the ring seal so as to be in fluid communication with the space. The cooling supply holes can be located closer to the axial upstream face of the ring seal than the axial downstream face. The aft span of the heat shield can include at least one exit passage extending therethrough and in fluid communication with the space between the ring seal and the heat shield. In one embodiment, the ring seal can have a radially inner side which can include a plurality of cooling channels.

DETAILED DESCRIPTION OF EMBODIMENTS OF THE INVENTION

Embodiments of the invention are directed to systems for minimizing the amount of air dedicated to cooling a ring seal in the turbine section of a turbine engine. Aspects of the invention will be explained in connection with various ring seal systems, but the detailed description is intended only as exemplary. Embodiments of the invention are shown in FIGS. 2-21, but the present invention is not limited to the illustrated structure or application. At the outset, it is noted that use herein of the terms "circumferential," "radial" and "axial" and variations thereof is intended to mean relative to the turbine.

Figure 1:
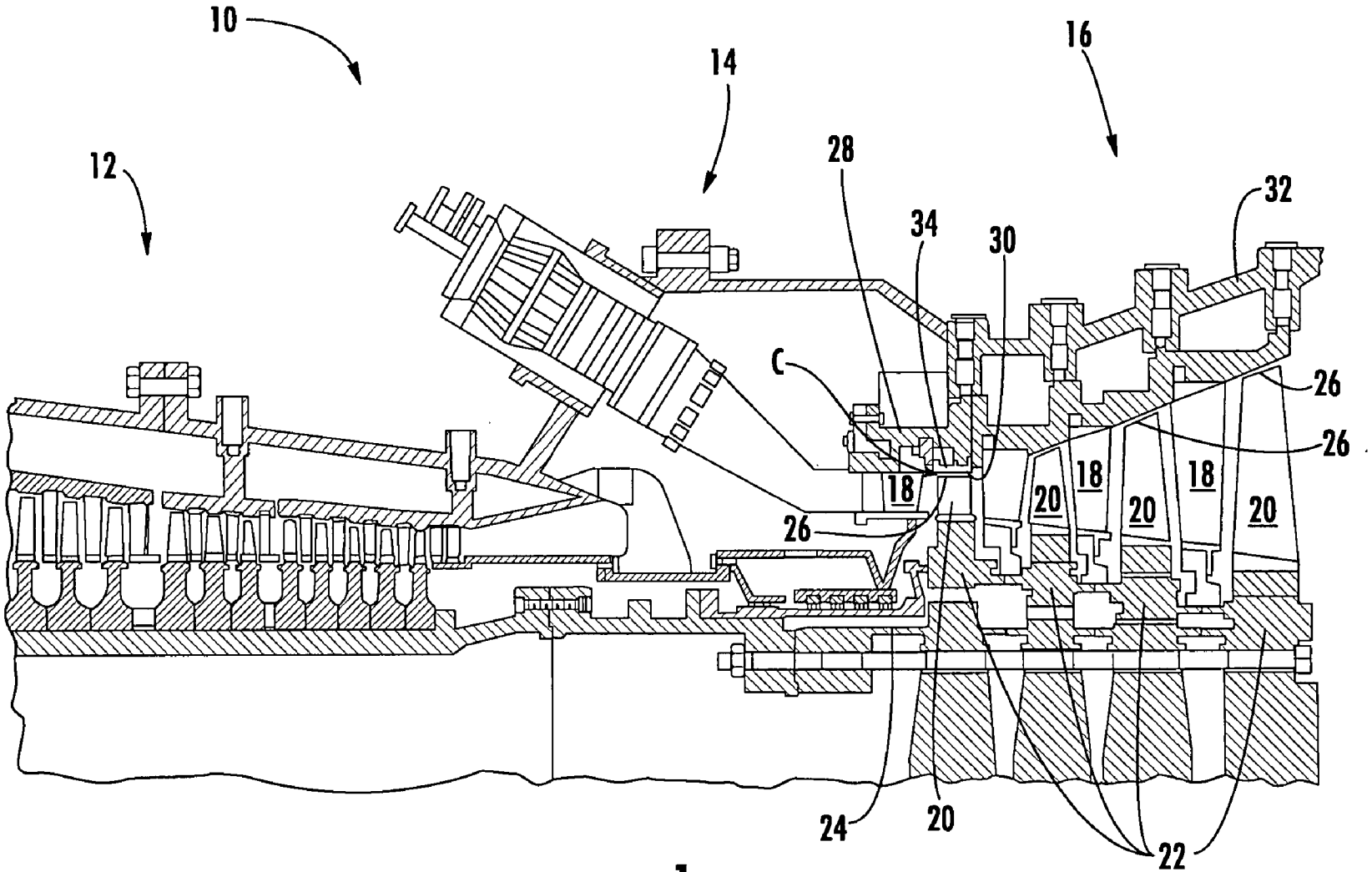
FIG. 1 (PRIOR ART)
FIG. 1 shows a cross-sectional view of the turbine section of a known turbine engine.
Figure 2:
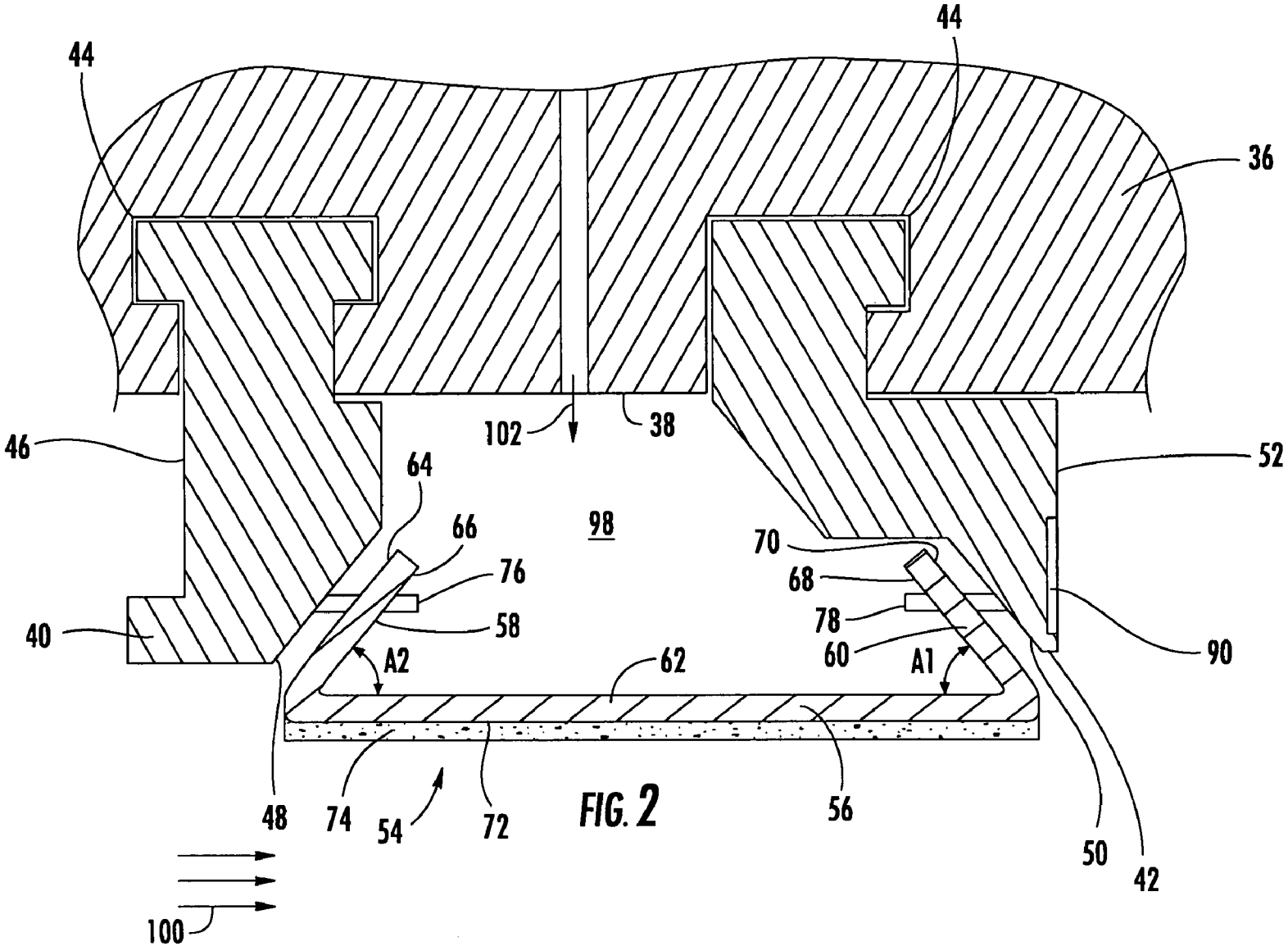
FIG. 2 is a cross-sectional view of a first embodiment of a ring seal system according to aspects of the invention.

A first ring seal system according to aspects of the invention is shown in FIGS. 2-7. Each of the components of the system will be discussed in turn. Referring to FIG. 2, the vane carrier 36 can be attached to the turbine outer casing (not shown) in any of the manners known in the art. The vane carrier 36 has an inner peripheral surface 38. A ring seal 54 according to aspects of the invention can be operatively connected to the vane carrier 36 in various ways.

In one embodiment, the ring seal 54 can be operatively connected to the vane carrier 36 by way of a forward isolation ring 40 and an aft isolation ring 42 provided on the vane carrier 36. The isolation rings 40, 42 and the vane carrier 36 can be a unitary construction, or the isolation rings 40, 42 can be attached to the vane carrier 36 in any of a number of known ways, such as by configuring a portion of each isolation ring 40, 42 to be received in a respective slot 44 provided in the vane carrier 36. The isolation rings 40, 42 can extend radially inward from the inner peripheral surface 38 of the vane carrier 36.

The isolation rings 40, 42 can extend about the entire inner peripheral surface 38 of the vane carrier 36; that is, each of the isolation rings 40, 42 can form a substantially 360 degree ring. The isolation rings 40, 42 can have various configurations. In one embodiment, each isolation ring 40, 42 can be a single piece. Alternatively, at least one of the isolation rings 40, 42 can be formed by two or more ring segments (not shown). For instance, two or more isolation ring segments can be substantially circumferentially abutted and/or can be joined by mechanical engagement or by one or more fasteners.

The forward isolation ring 40 can have an upstream face 46 and a downstream face 48. Likewise, the aft isolation ring 42 can have an upstream face 50 and a downstream face 52. These faces 46, 48, 50, 52 can be substantially flat, or they can include one or more protrusions, bends or other non-flat features. The isolation rings 40, 42 can have various cross-sectional shapes. The forward and aft isolation rings 40, 42 may or may not be substantially identical to each other at least in any of the above-described respects.

As noted above, the ring seal 54 is operatively connected to the vane carrier 36. One example of a ring seal 54 according to aspects of the invention is shown in FIG. 2. The ring seal 54 can be formed by one or more ring segments 56 (only one of which is shown). In cases where the ring seal 54 is made of two or more segments 56, the segments 56 can be substantially circumferentially adjacent to each other to collectively form a ring. The individual segments 56 can substantially circumferentially abut each other, or they can be connected to neighboring segments by, for example, bolts or other fasteners. In one embodiment, the ring seal 54 can be made of two substantially 180 degree segments.

In one embodiment, the ring seal 54 can be a relatively thin-walled structure having a forward span 58 and an aft span 60 joined by a substantially axial extension 62. The forward span 58 can have an axial upstream face 64, which can define an axial upstream face of the ring seal 54, and it can have an axial downstream face 66. Similarly, the aft span 60 can have an axial upstream face 68 and an axial downstream face 70, which can define an axial downstream surface of the ring seal 54. The axial extension 62 can define a gas path face 72 of the ring seal 54. In one embodiment, the gas path face 72 can be coated with a thermal insulation material, such as friable gradable insulation (FGI) 74, to allow for higher temperature operation and/or to provide environmental protection.

The forward and aft spans 58, 60 can be positioned at various angles relative to the axial extension 62. In one embodiment, an angle A1 between the aft span 60 and the axial extension 62 can be less than 90 degrees. In some engine designs, such an angled relationship may be necessary to keep the aft isolation ring 42 situated axially downstream of the aft span 60. The aft span 60 can be adapted to substantially matingly engage at least a portion of the aft isolation ring 42, such as at least a portion of the upstream face 50. There can be any suitable angle A2 between the forward span 58 and the axial extension 62. In one embodiment, the angle A2 can be substantially identical to the angle A1 to maintain symmetry. As a result, the cross-sectional shape of the ring seal 54 can be generally trapezoidal without a top, as shown in FIG. 2. However, the angles A1, A2 can be different. For instance, in one embodiment, the angle A2 can be about 90 degrees and the angle A1 can be an acute angle.

According to aspects of the invention, the ring seal 54 can be made of any of a number of materials with suitable high temperature properties. For example, the ring seal 54 can be made of a ceramic material, which includes ceramic matrix composites (CMC). In one embodiment, the ring seal can be made of an oxide CMC. A CMC ring seal can be formed in various ways including, for example, by hand lay up. In such case, the fibers of the CMC can be arranged as needed. For instance, the fibers can be arranged at substantially 90 degrees relative to each other, such as a 0-90 degree orientation or a +/−45 degree orientation.

The ring seal 54 can be operatively connected to the isolation rings 40, 42 in various ways. In one embodiment, the ring seal 54 can be operatively connected to the isolation rings 40, 42 by a plurality of elongated fasteners, such as pins. For instance, a first plurality of pins 76 can operatively connect the forward isolation ring 40 to the forward span 58 of the ring seal 54, and a second plurality of pins 78 can operatively connect the aft isolation ring 42 to the aft span 60 of the ring seal 54. The pins 76, 78 can be made of any suitable material, such as metal. The pins 76, 78 can have any cross-sectional shape, such as circular, polygonal, rectangular, or oblong. The first and second plurality of pins 76, 78 may or may not be substantially identical to each other.

In order to facilitate installation of the ring seal 54, the first plurality of pins 76 and/or the second plurality of pins 78 can be removable. The following discussion will be directed to a system in which the first plurality of pins 76 is affixed to the forward isolation ring 40, and the second plurality of pins 78 is removable from the aft isolation ring 42. It will be understood that such an arrangement is provided to facilitate discussion, and aspects of the invention are not limited to such an arrangement.

Figure 3:
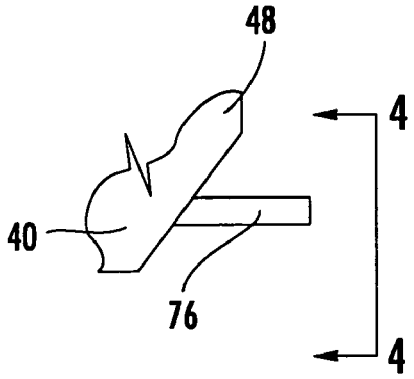
FIG. 3 is a close-up view of a portion of a forward isolation ring according to aspects of the invention, showing a pin extending therefrom.
Figure 4:
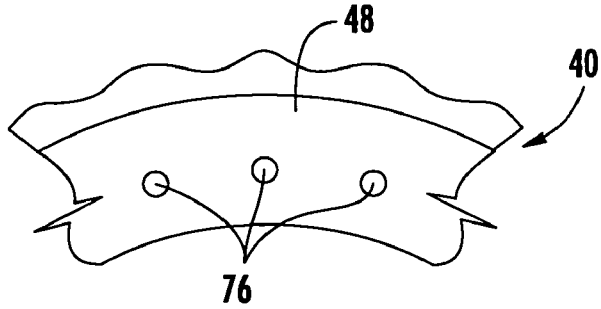
FIG. 4 shows one arrangement of pins on the forward face isolation ring according to aspects of the invention, viewed from line 4-4 in FIG. 3.

As shown in FIG. 3, the first plurality of pins 76 can be affixed to forward isolation ring 40 so that the pins 76 extend substantially axially away therefrom. The pins 76 can be affixed to the forward isolation ring 50 by, for example, welding, brazing and/or mechanical engagement. Any quantity of pins 76 can be used to operatively connect the forward span 58 and the forward isolation ring 40. In one embodiment, three pins 76 can be used, as shown in FIG. 4. The pins 76 can be arranged in various manners. For example, the pins 76 can be arranged in an arc-like pattern, but aspects of the invention are not limited to any particular arrangement. The number and arrangement of the pins 76 can be optimized for the load conditions and specific geometric allowances.

Figure 5:
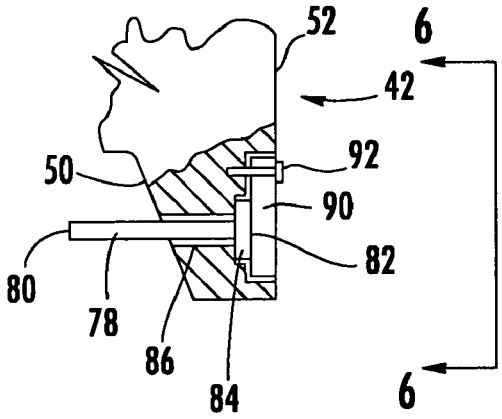
FIG. 5 is a partially broken away view of an aft isolation ring according to aspects of the invention, showing one manner in which a pin can be secured to the aft isolation ring.
Figure 6:
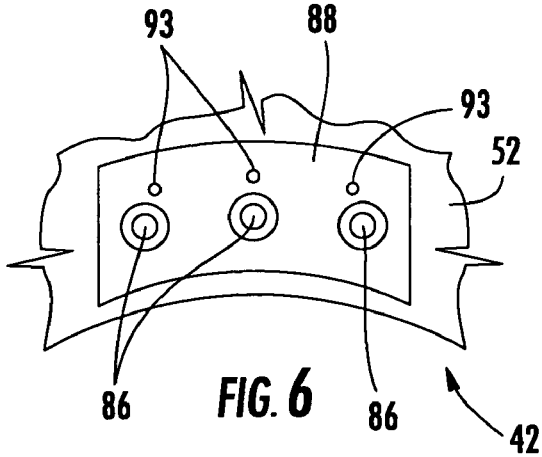
FIG. 6 is a view of the aft isolation ring according to aspects of the invention, viewed from line 6-6 in FIG. 5, showing one arrangement of holes in the aft isolation ring.

FIGS. 5 and 6 show one example of the second plurality of pins 78 that can removably engage the aft isolation ring 42 and the aft span 60. Each of the second plurality of pins 78 includes a first end 80 and a second end 82. The second end 82 of each pin 78 preferably includes a head 84. The aft isolation ring 42 can include a plurality of holes 86 extending substantially axially therethrough to receive the pins 78. The pins 78 can be slid into place into the holes 86 so that the first end 80 of each pin 78 protrudes axially beyond the upstream face 50 of the aft isolation ring 42, as shown in FIG. 5. The head 84 of the pins 78 can prevent the pins 78 from passing through the holes 86. In one embodiment, the holes 86 can be countersunk so that the head 84 of each pin 78 is recessed from the downstream face 52 of the aft isolation ring 42. Like the first plurality of pins 76, the quantity and arrangement of the second plurality of pins 78 can be optimized as needed.

Preferably, the holes 86 can be provided in a recessed portion 88 of the downstream face 52 of the aft isolation ring 42. A locking plate 90 can be positioned in the recessed portion 88 so as to be substantially flush with the downstream face 52 of the aft isolation ring 42. The locking plate 90 can bear against the heads 84 of the pins 78 so that the heads 84 are clamped between the locking plate 90 and the aft isolation ring 42, thereby holding the pins 78 in place. The locking plate 90 can be attached to the aft isolation ring 42 by brazing, welding, mechanical engagement, and/or fasteners, just to name a few possibilities. In one embodiment, the locking plate 90 can be secured to the aft isolation ring 42 by a plurality of bolts 92. In such case, the aft isolation ring 42 can provided a plurality of holes 93, which can be threaded, to receive and engage the bolts 92.

Figure 7:
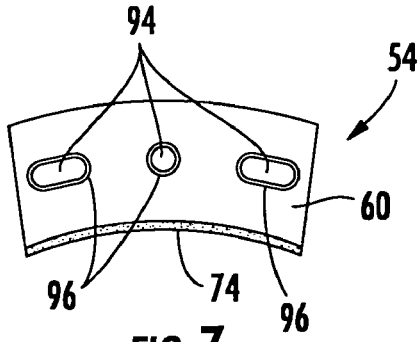
FIG. 7 is an axial rear view of the aft span of a ring seal according to aspects of the invention.

The forward and aft spans 58, 60 of the ring seal 54 can include a series of cutouts 94 to receive the pins 76, 78 so as to operatively connect the ring seal 54 and the isolation rings 40, 42. FIG. 7 shows a plurality of cutouts 94 formed in the aft span 60 of the ring seal 54. The cutouts 94 are arranged in an arcuate pattern. Cutouts (not shown) can also be formed in the forward span 58 of the ring seal 54. In one embodiment, the quantity and the arrangement of the cutouts 94 in the aft span 60 of the ring seal 54 can be substantially identical to the quantity and the arrangement of the cutouts in the forward span 58. However, the quantity and/or arrangement of cutouts on the forward span 58 can be different from the quantity and arrangement of cutouts 94 on the aft span 60.

Naturally, the cutouts 94 in the forward and aft spans 58, 60 can be sized and arranged to correspond to receive the first and second plurality of pins 76 and 78, respectively. Preferably, all of the cutouts 94 in the ring seal 54 are oversized to allow for differential thermal expansion between the ring seal 54 and the pins 76, 78. Preferably, at least one of the cutouts 94 in each span 58, 60 can be substantially circular or otherwise shaped to substantially correspond to the cross-sectional shape of the pins 76, 78. The remainder of the cutouts 94 can be slotted to accommodate circumferential and radial growth of the isolation rings 40, 42. The cutouts 94 can be formed in the spans 58, 60 by any suitable process.

Wear resistant coatings 96 can be applied to the cutouts 94 to minimize wear due to vibration, among other things. Wear resistant coatings 96 can also be applied to the contacting surfaces between the ring seal 54 and the isolation rings 40, 42, particularly the downstream face 70 of the aft span 60 and the upstream face 50 of the aft isolation ring 42. The wear resistant coating 96 can be any suitable material.

During assembly, the ring seal 54 can be positioned so that the cutouts 94 in the forward span 58 receive the first plurality of pins 76. Next, the second plurality of pins 78 can be installed, as described above, with the locking plate 90 holding the pins 78 in place. The ring seal 54 can be suspended between the isolation rings 40, 42 by the pins 76, 78. A space 98 can be defined between the ring seal 54 and the inner peripheral surface 38 of the vane carrier 36.

During engine operation, the ring seal 54 will be exposed to the high temperature combustion gases 100. Because the ring seal 54 is made of a ceramic material, it can withstand the exposure to the hot gases 100 in the turbine section. Nonetheless, some cooling should be provided to the ring seal 54, though it will be appreciated that the amount of coolant needed will be less than that required for a metal ring seal. In one embodiment, a coolant, such as air 102 or other suitable fluid, can be supplied in the space 98. The source of the coolant can be internal or external to the engine. As a result, there will be thermal gradients across the ring seal 54. As noted above, the ring seal 54 can be coated with a thermal insulating coating to minimize such thermal gradients.

The infiltration of hot combustion gases 100 into the space 98 should be minimized because it can cause degradation of other components. To that end, the coolant can be supplied to the space 98 at a higher pressure than that of the hot combustion gases 100. The coolant can be at a sufficient pressure so that if there are any leaks, then it will be the coolant that leaks into the turbine gas path 100 as opposed to the hot gases 100 entering the space 98.

It should be noted that the temperature and pressure of the combustion gases 100 decrease as the gases 100 travel through the turbine section. Thus, a larger pressure can act on or near the axial upstream face 64 of the ring seal 54 compared to the pressure acting on or near the axial downstream face 70. Consequently, the ring seal 54 can be pushed axially downstream so that the downstream face 70 of the aft span 60 operatively engages at least a portion of the upstream face 50 of the aft isolation ring 42. The aft span 60 can act as an axial restraint on the ring seal 54. As noted earlier, the downstream face 70 of the aft span 60 can be configured to substantially matingly engage the upstream face 50 of the aft isolation ring 42. Thus, when these substantially mating surfaces are brought into contact, a seal can be formed to minimize coolant leakages near the downstream end of the ring seal 54.

During engine operation, the ring seal 54 can be axially restrained by the isolation rings 40, 42. Radial and circumferential restraints can be provided by the pins 76, 78. As noted earlier, the cutouts 94 in the ring seal 54 can be adapted to permit relative thermal growth of the isolation rings 40, 42, the ring seal 54 and the pins 76, 78. By operatively connecting the ring seal 54 to the isolation rings 40, 42 by pins 76, 78, the ring seal 54 is loaded in the axial direction. In the case of a CMC ring seal 54, the fibers can be oriented in the axial direction (i.e., the planar direction of the ring seal 54), which is the direction in which a CMC component exhibits the highest strength characteristics.

In light of the above, it will be appreciated that the amount of air 102 needed to cool the ring seal 54 can be reduced, which can have a direct favorable impact on engine performance and emissions control.

A variation of the first embodiment of the ring seal system according to aspects of the invention is shown in FIGS. 8-13. The foregoing description of the vane carrier 36, the isolation rings 40, 42, the ring seal 54 and the pins 76, 78 applies equally unless otherwise noted.

The forward and aft spans 58, 60 of the ring seal 54 can both be positioned at substantially right angles to the axial extension 62. Thus, the ring seal 54 can be substantially U-shaped in cross-section, which may be easier to manufacture compared to a ring seal 54 in which the one of the spans 58, 60 is at an acute angle relative to the axial extension 62. The ring seal 54 can be made of a ceramic material, which is intended to include ceramic matrix composites, and the foregoing discussion regarding such materials applies equally here. The hot gas face 72 of the axial extension can be coated with a thermal insulating material, such as FGI 74.

The ring seal 54 can be operatively connected to the isolation rings 40, 42 in various ways. In one embodiment, the ring seal 54 can be operatively connected to the isolation rings 40, 42 by a plurality of elongated fasteners, such as pins. For instance, a first plurality of pins 76 can operatively connect the forward isolation ring 40 to the forward span 58 of the ring seal 54, and a second plurality of pins 78 can operatively connect the aft isolation ring 42 to the aft span 60 of the ring seal 54. The pins 76, 78 can be made of any suitable material, such as metal. The pins can have any cross-sectional shape, such as circular, polygonal, rectangular, or oblong.

To facilitate installation, the first plurality of pins 76 and/or the second plurality of pins 78 should be removable. In one embodiment, the first plurality of pins 76 can be affixed to the forward isolation ring 40, and the second plurality of pins 78 can be removable from the aft isolation ring 42. While the following discussion will be directed to such an arrangement, it will be understood that aspects of the invention are not limited to any particular arrangement.

Figure 9:
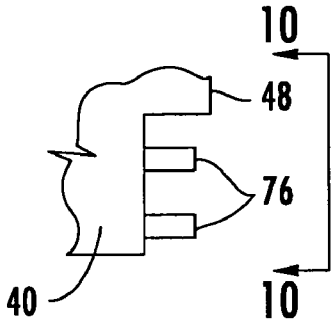
FIG. 9 is a close-up view of a portion of a forward isolation ring according to aspects of the invention, showing a plurality of pins extending therefrom.
Figure 10:
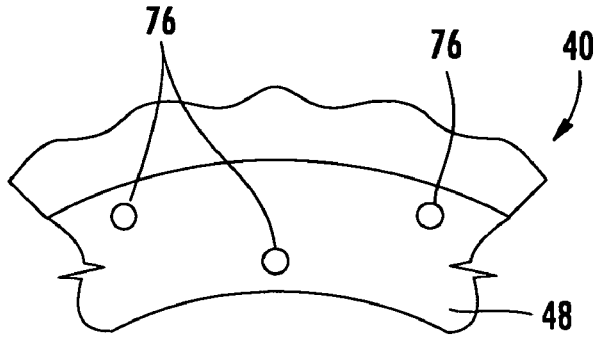
FIG. 10 shows one arrangement of pins on the forward face isolation ring according to aspects of the invention, viewed from line 10-10 in FIG. 9.

As shown in FIG. 9, the first plurality of pins 76 at the forward isolation ring 40 can be affixed to isolation ring 40 so that the pins 76 extend substantially axially away therefrom. The pins 76 can be affixed to the forward isolation ring 40 by, for example, welding, brazing and/or mechanical engagement. Any quantity of pins 76 can be used to operatively connect the forward span 58 and the forward isolation ring 40. In one embodiment, three pins 76 can be used, as shown in FIG. 9. The pins 76 can be arranged in various manners. For example, the pins 76 can be arranged in a generally V-shaped pattern, as shown in FIG. 10, but other arrangements are possible according to aspects of the invention. The quantity and arrangement of the first plurality of pins 76 can be optimized for the load conditions and specific geometric allowances.

Figure 11:
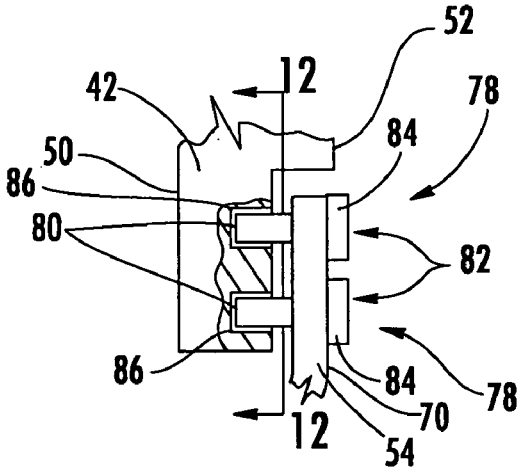
FIG. 11 is a close up view of the interface between the aft isolation ring and the aft span of a ring seal according to aspects of the invention.
Figure 12:
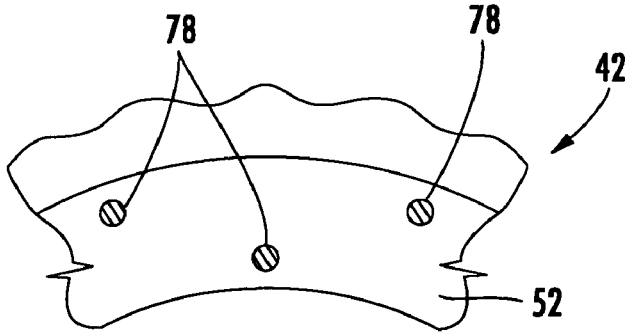
FIG. 12 shows one arrangement of pins that connect the aft span of the ring seal and the aft isolation ring according to aspects of the invention.

FIG. 11 shows one example of the aft isolation ring 42 and the aft span 60 being operatively connected by the second plurality of pins 78 such that the pins 78 can be removed. Each of the second plurality of pins 78 can include a first end 80 and a second end 82. The second end 82 of each pin 78 preferably includes a head 84. Like the first plurality of pins 76, the quantity and arrangement of the second plurality of pins 78 can be optimized as needed. In one embodiment, the second plurality of pins 78 can comprise three pins that are arranged in a generally V-shaped pattern, as shown in FIG. 12.

Figure 13:
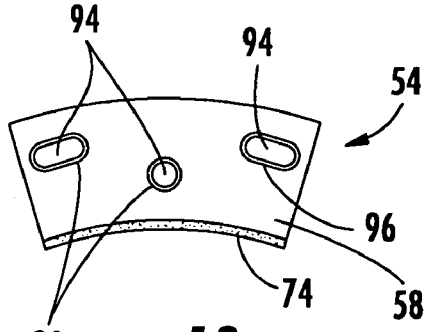
FIG. 13 is an axial front view of the forward span of a ring seal according to aspects of the invention.

As shown in FIG. 13, a plurality of cutouts 94 can be formed in the forward span 58 of the ring seal 54. The cutouts 94 can substantially correspond to the quantity and arrangement of the first plurality of pins 76. For instance, three cutouts 94 can be arranged in a generally V-shaped pattern. Each of the first plurality of pins 76 can be received in a respective cutout 94 so as to operatively connect the forward span 58 of the ring seal 54 to the forward isolation ring 40.

In one embodiment, the quantity and arrangement of cutouts 94 in the forward span 58 can be substantially identical to the quantity and arrangement of cutouts (not shown) in the aft span 60. However, the quantity and/or arrangement of cutouts 94 in the spans 58, 60 can differ. The earlier discussion of the cutouts 94 applies equally here.

Figure 8:
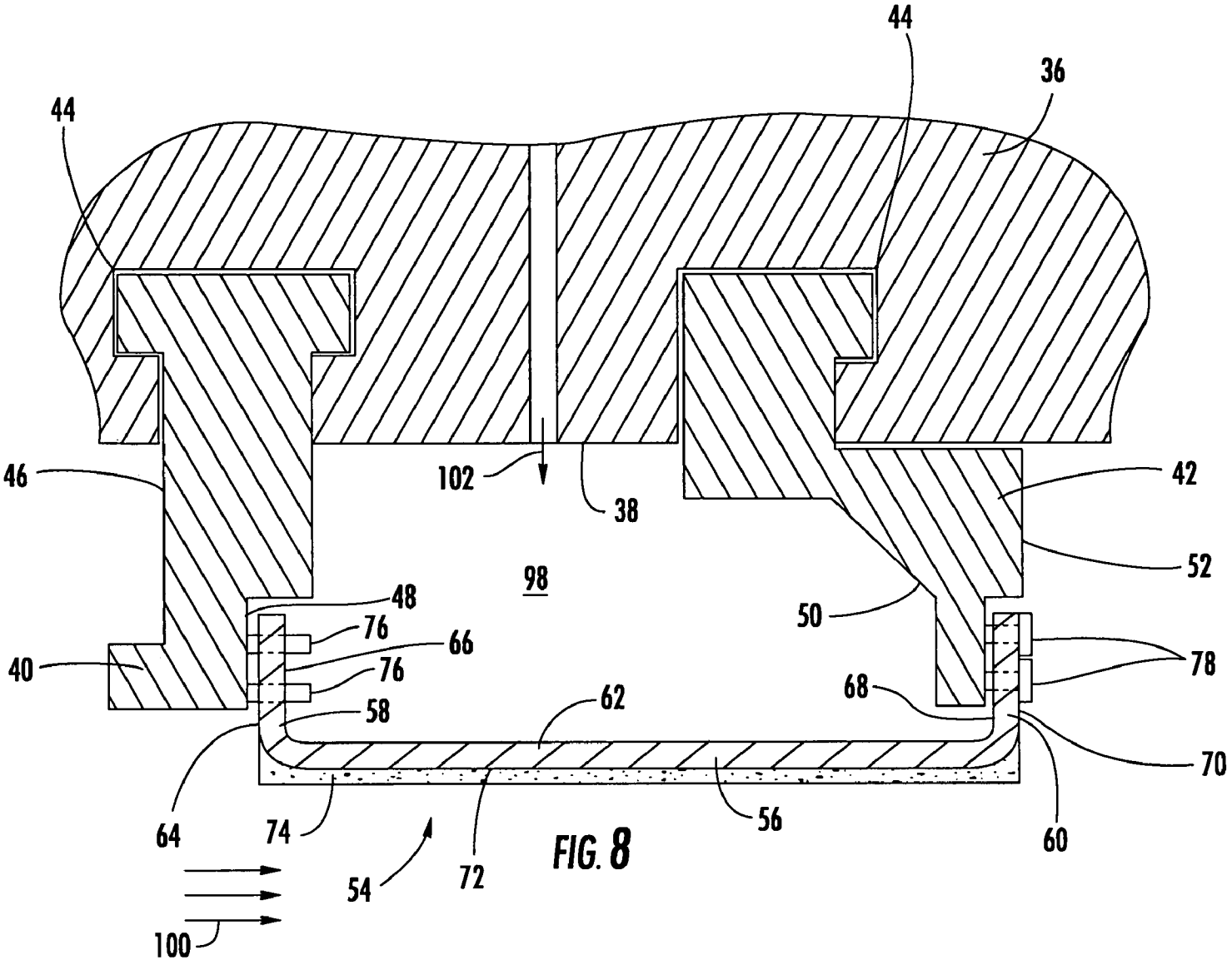
FIG. 8 is a cross-sectional view of a second embodiment of a ring seal system according to aspects of the invention.

According to aspects of the invention, the aft span 60 of the ring seal 54 can be positioned axially downstream of at least a portion of the aft isolation ring 42. As noted earlier, the aft span 60 and the aft isolation ring 42 can be operatively connected by the second plurality of pins 78. Each of the second plurality of pins 78 can include a first end 80 and a second end 82 having a head 84. In one embodiment, the first end 80 of each pin 78 can be slid through a respective cutout 94 in the aft span 60 of the ring seal 54. The head 84 of each pin 78 can engage the downstream face 70 of the aft span 60, as shown in FIGS. 8 and 11.

The first end 80 of each pin 78 can extend substantially axially through the cutouts 94 and into engagement with the aft isolation ring 42. There are various ways in which the pins 78 can engage the aft isolation ring 42. In one embodiment, each pin 78 can threadably engage the holes 86 in the aft isolation ring 42. Alternatively, the pins 78 can extend substantially axially through the aft isolation ring 42 such that the first end 80 of each pin 78 extends beyond at least a portion of the upstream face 50 of the aft isolation ring 42. In such case, the pins 78 can be held in place by engagement with a retainer, such as a weld, cotter pin or nut.

As shown in FIG. 13, a wear resistant coating 96 can be applied to the cutouts 94 to minimize wear due to vibration, among other things. A wear resistant coating can also be applied to the contacting surfaces between the ring seal and the isolation rings (i.e., the aft surface of the aft isolation ring 42 and the upstream face 68 of the aft span 60). Any suitable material can be used for the wear resistant coating 96.

During assembly, the ring seal 54 can be positioned so that each of the first plurality of pins 76 slides into the cutouts 94 in the forward span 58 of the ring seal 54. Next, the second plurality of pins 78 can be inserted through the cutouts in the aft span 60 of the ring seal 54 and into engagement with the aft isolation ring 42. The ring seal 54 can be suspended between the isolation rings 40, 42 by the pins 76, 78. A space 98 can be defined between the ring seal 54 and the inner peripheral surface 38 of the vane carrier 36.

The previous discussion of the operation and the cooling of the ring seal system applies equally here and is incorporated by reference. However, it should be noted that the restraint in the downstream axial direction can be provided by the heads 84 of the second plurality of pins 78. It will be appreciated that the above-described system can reduced the amount of coolant needed to cool the ring seal. Such cooling savings can have a direct impact on engine performance and emissions control.

Another system for minimizing the cooling of a ring seal according to aspects of the invention is shown in FIGS. 14-17. Generally, the system includes a metal ring seal 120 with a ceramic heat shield 122. Each of the components of the system will be discussed in turn.

Figure 14:
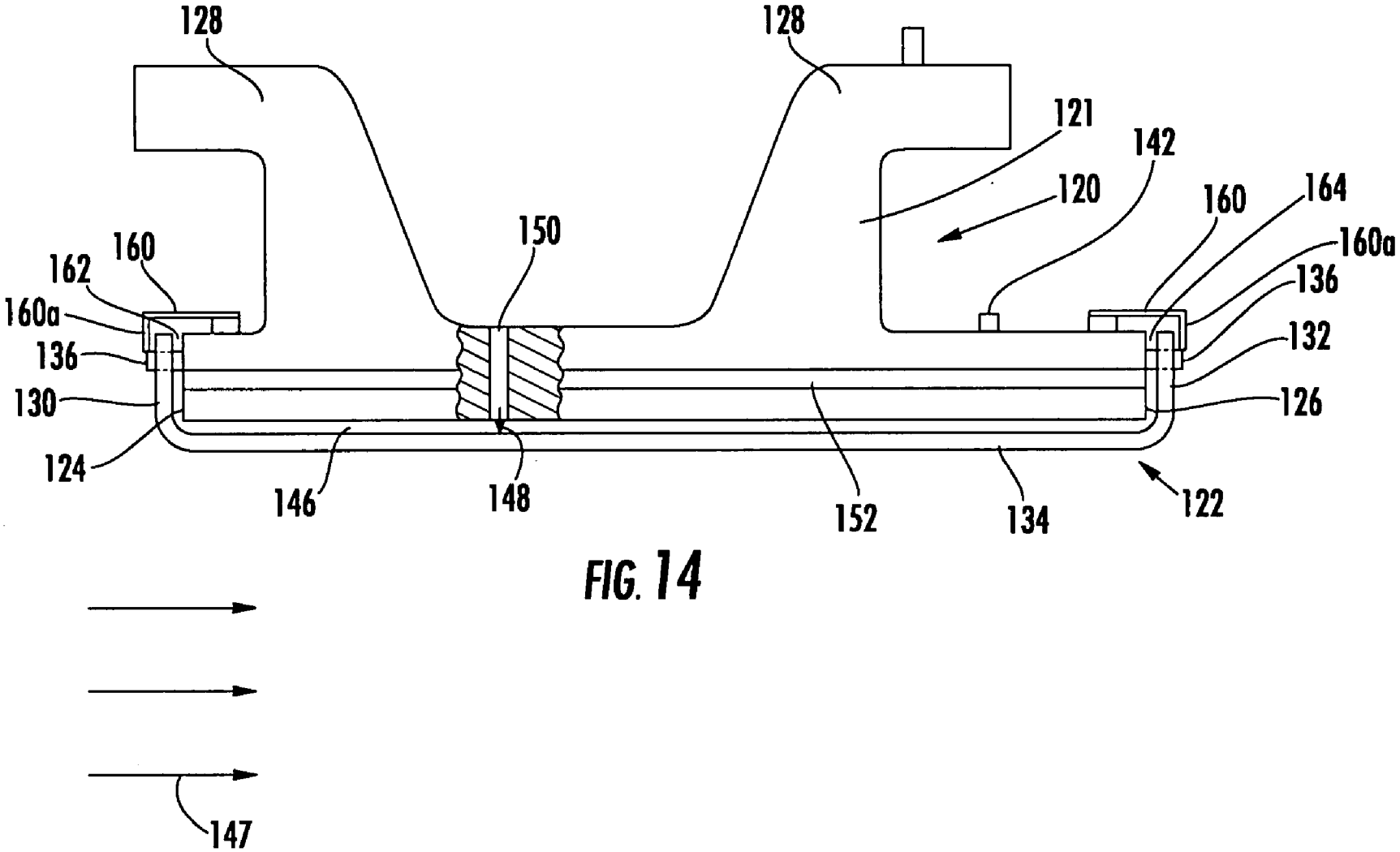
FIG. 14 is a cross-sectional view of a third embodiment of a ring seal system according to aspects of the invention.

The ring seal 120 can be made of any metal that is suitable for the operational loads of the turbine including, for example, super alloys. The ring seal 120 can have an axial upstream face 124 and an axial downstream face 126. The ring seal 120 can be formed by a plurality of ring segments 121 (one of which is shown in FIG. 14). In such case, the segments can be substantially circumferentially adjacent to each other to collectively form a ring. The individual segments can substantially circumferentially abut each other, and neighboring segments can be connected by, for example, bolts or other fasteners. In one embodiment, the ring seal 120 can be made of two substantially 180 degree segments.

The ring seal 120 can be adapted to attach to a vane carrier (not shown) or to isolation rings (not shown) by any of a number of known ways. For instance, the ring seal 120 in FIG. 14 provides attachment hooks 128 that can be received in, for example, mating slots in a vane carrier (not shown).

The heat shield 122 can be made of a ceramic material, which can include ceramic matrix composites. The heat shield 122 can have various configurations. For instance, as shown in FIG. 14, the heat shield 122 can be elongated U-shaped. In such case, the heat shield 122 can have a forward span 130, an aft span 132 and an axial extension 134 connecting the two spans 130, 132. The forward and aft spans 130, 132 of the heat shield 122 can be configured to generally follow the contour of the upstream and downstream faces 124, 126 of the ring seal 120. In one embodiment, the forward and aft spans 130, 132 can be arranged at substantially 90 degrees relative to the axial extension 134. However, other arrangements of the forward and aft spans 130, 132 are possible, and the forward and aft spans 130, 132 can extend at different angles relative to the axial extension 134. The heat shield 122 can be formed by any suitable process, including hand lay-up.

The ring seal 120 and the heat shield 122 can be joined together in various ways. For example, each of the spans 130, 132 of the heat shield 122 can be operatively connected to the ring seal 120 by a plurality of elongated fasteners. The fasteners can be made of any of a number of materials, such as metal or ceramic, depending on the local operational conditions in which the fasteners will be used. The fasteners can have almost any cross-sectional geometry; in one embodiment, the fasteners can be circular in cross-section.

Figure 16:
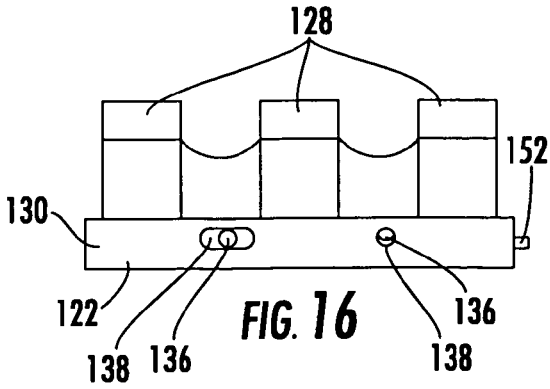
FIG. 16 is an axial front elevational view of a ring seal system according to aspects of the invention.
Figure 17:
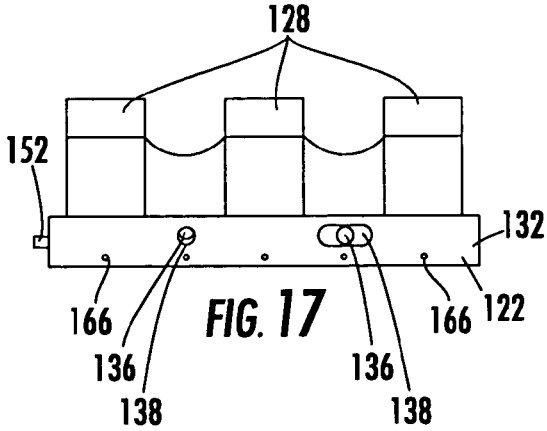
FIG. 17 is an axial rear elevational view of a ring seal system according to aspects of the invention.

The elongated fasteners can be, for example, pins 136. In one embodiment, a plurality of pins 136 can connect the forward span 130 of the heat shield 122 to the upstream face 124 of the ring seal 120. Likewise, a plurality of pins 136 can connect the aft span 132 of the heat shield 122 to the downstream face 126 of the ring seal 120. The pins 136 can be arranged in any suitable manner. For instance, as shown in FIGS. 16 and 17, the pins 136 can be substantially aligned in a row; however, other arrangements are possible. The quantity and arrangement of the pins 136 operatively connecting the forward span 130 of the heat shield 122 to the upstream face 124 of the ring seal 120 can be identical to or different than the quantity and arrangement of pins 136 operatively connecting the aft span 132 of the heat shield 122 to the downstream face 126 of the ring seal 120.

The pins 136 can extend through cutouts 138 provided in the forward and aft spans 130, 132 of the heat shield 122. Preferably, at least one of the cutouts 138 in each span 130, 132 can be substantially circular or otherwise substantially correspond to the cross-sectional shape of the pins 136. The remainder of the cutouts 138 can be slotted to accommodate differential circumferential and radial movement and/or growth of the ring seal 120. In any case, it is preferred if each of the cutouts 138 in the heat shield 122 is oversized to allow for differential thermal expansion between the ring seal 120 and the pins 136. Naturally, the quantity and arrangement of the cutouts 138 substantially corresponds to the desired quantity and arrangement of the pins 136 to operatively connect the ring seal 120 and the heat shield 122. The cutouts 138 can be formed in the spans 130, 132 by any suitable process.

Figure 15:
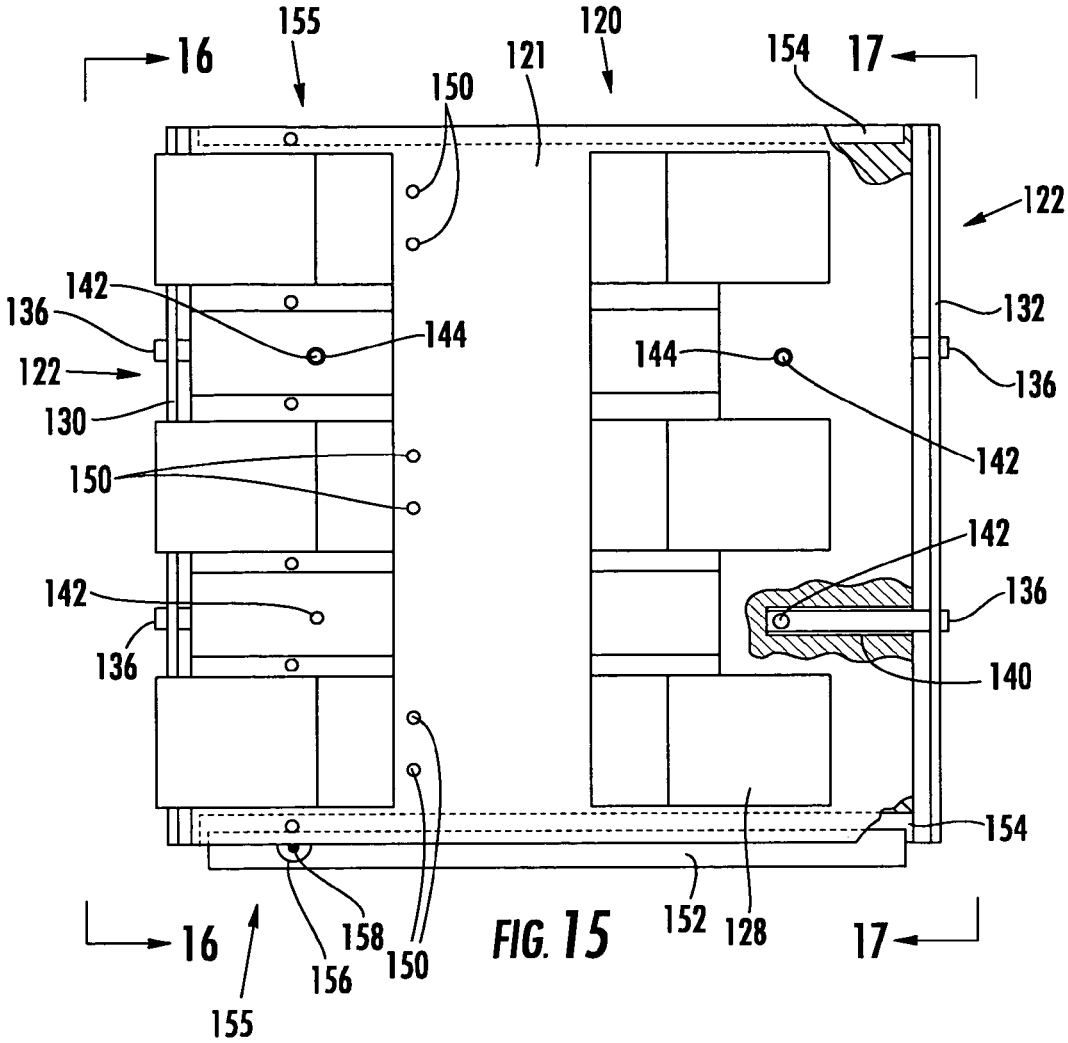
FIG. 15 is a top plan view of a ring seal system according to aspects of the invention.

The pins 136 can extend through the cutouts 138 and into engagement with the ring seal 120. The pins 136 can engage the ring seal 120 in various ways. For example, each of the pins 136 can be received into a respective passage 140 formed in the ring segment 120, as shown in FIG. 15. The passages 140 can substantially align with the cutouts 138 in the heat shield 122. Once aligned, each pin 136 can be received in an aligned passage 140-cutout 138 pair. Ideally, the pins 136 can be secured in place to ensure they do not come loose during engine operation. There are numerous ways in which the pins 136 can be secured to the ring seal 120 including, for example, by brazing, welding, adhesives, mechanical engagement and threaded engagement. In one embodiment, the pins 136 can be held in place by a substantially transverse stake 142. To that end, a transverse passage 144 can be provided in the ring seal 120 to receive the stake 142, as shown in FIG. 15. Likewise, each pin 136 can include a passage (not shown) or a recess (not shown) to receive a stake 142. The stakes 142 can also be secured to the ring seal 120, such as by tack welding.

Once assembled, the heat shield 122 can be suspended from the ring seal 120. The heat shield 122 can be spaced from the ring seal 120 such that a space 146 is defined therebetween (see FIG. 14). During engine operation, the majority of the mechanical loads can be carried by the metal ring seal 120, which has greater strength properties compared to ceramic. The thermal loads can be carried by the ceramic heat shield 122. Thus, the advantages of both material classes can be exploited. Further, by protecting the metal ring seal 120 from the thermal loads, it will be appreciated that less cooling air is required for the ring seal 120.

It should be noted that there is a possibility that the hot gases 147 in the turbine can infiltrate the space 146 between the heat shield 122 and the ring segment 120. Such infiltration can detract from the cooling benefits achieved by the system according to aspects of the invention. To reduce the likelihood of such an occurrence, a coolant can be supplied to the space 146, such as by way of one or more coolant supply passages 150. In one embodiment, the coolant can be air 148, which can be diverted from another portion of the engine or supplied by an external source. The coolant can further ensure that the metal ring seal 120 is kept within the critical temperature limit.

In order to keep the hot gases from entering the space 98, the coolant must be supplied at a higher pressure than the pressure of the hot gases 147. In one embodiment, the coolant supply passages 150 can be located closer to the upstream face 124 of the ring seal 130 as opposed to the downstream face 126. Such positioning of the coolant supply passages 150 can be advantageous because the pressure of the hot gases 147 decreases as the gases 147 travel through the turbine section. Thus, the pressure of the hot gases 147 is higher at the axial upstream face 124 of the ring seal 120 compared to the pressure of the hot gases 147 at the axial downstream face 126 of the ring seal 120. Accordingly, there can be a greater risk of infiltration at or near the axial upstream face 124 of the ring seal 120. By supplying the coolant closer to the axial upstream face 124, such risk can be minimized.

Because the coolant is supplied at a high pressure, it should be noted that the ceramic heat shield 122 can experience a relatively small amount of loading. The heat shield 122 can be subjected to additional loading due to the pressure and temperature differences across the heat shield 122. Such loading should be minimized, or the heat shield 122 can be designed to accommodate such a load.

The ring seal system can include additional features to facilitate cooling and/or to prevent hot gas infiltration. For instance, when the ring seal 120 is made of a plurality of ring segments 121, the ring segments 121 can include side seals 152. Each circumferential end 155 of the ring segment 121 can include a side slot 154 to receive a portion of a side seal 152. Ideally, the side seal 152 is retained in the slot 154. For example, the side seal 152 can include one or more cutouts 156. An elongated member, such as a pin 158, can be received in the cutout 156 and secured to the ring segment 121. In one embodiment, the pin 158 can be welded to the circumferential end 155 of the ring segment 121. The side seal 152 can extend beyond the circumferential end 155 of the ring segment 121 and can be received in a side slot of a neighboring ring segment (not shown).

Alternatively or in addition, one or more seal plates 160 can be used to minimize hot gas infiltration through a gap 162 formed between the forward span 130 of the heat shield 122 and the upstream face 124 of the ring seal 120. Similarly, one or more seal plates 160 can be used to minimize leakage through a gap 164 formed between the aft span 132 of the heat shield 122 and the downstream face 126 of the ring seal 120. In one embodiment, the seal plates 160 can be elongated L-shaped members with a lip portion 160*a*. The seal plates 160 can be made of metal or other suitable material. The seal plates 160 can be tack welded in place on the ring seal 120. The seal plates 160 can be positioned such that the lip portion 160*a* of one of the seal plates 160 is situated axially upstream of the forward span 130 of the heat shield and such that the lip portion 160*a* of another of the seal plates 160 is situated axially downstream of the aft span 132, as shown in FIG. 14. The seal plates 160 can at least partially obstruct the fluid communication between the space 146 and the hot gas path 147 by way of the gaps 162, 164.

While such features can minimize hot gas infiltration, the coolant must exit the space 146 between the ring seal 120 and the heat shield 122. In one embodiment, such as shown in FIG. 17, a plurality of exit passages 166 can be provided in the heat shield 122 to allow the coolant to exit the space 146 and enter the hot gas path. Preferably, such exit passages 166 extend through the aft span 132 of the heat shield 122.

Figure 18:
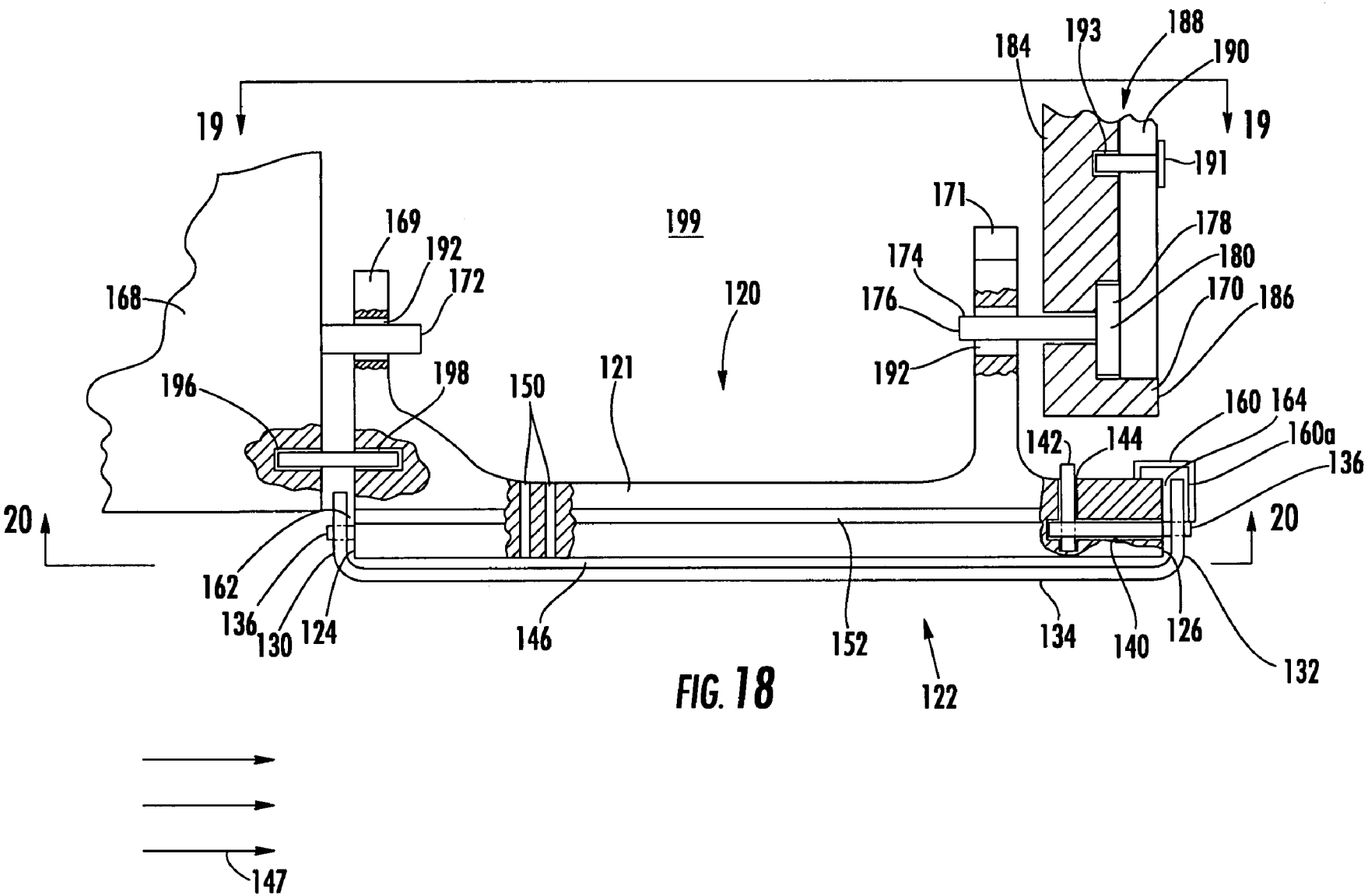
FIG. 18 is a cross-sectional view of an alternative ring seal according to aspects of the third embodiment of the ring seal system according to aspects of the invention.

FIGS. 18-21 show a variation of the second ring seal system according to aspects of the invention. The above discussion applies equally here, except for the additional features noted below. The ring seal 120 can be configured to allow other manners of attachment. For example, as shown in FIG. 18, the metal ring seal 120 can be operatively connected to a forward isolation ring 168 and an aft isolation ring 170 by a plurality of elongated fasteners. To that end, the ring seal 120 can include a forward span 169 and an aft span 171.

In one embodiment, the elongated fasteners can be pins. A first plurality of pins 172 (only one of which is shown) can be affixed to forward isolation ring 168 so that the pins 172 extend substantially axially away therefrom. The pins 172 can be affixed to the forward isolation ring 168 by, for example, welding, brazing and/or mechanical engagement. Any quantity of pins 172 can be used to operatively connect the forward span 169 and the forward isolation ring 168. There can be any quantity of pins 172, and the pins 172 can be arranged in various manners.

A second plurality of pins 174 can connect the aft span 171 and the aft isolation ring 170. In one embodiment, the pins 174 can be removable. Each of the second plurality of pins 174 can include a first end 176 and a second end 178, which preferably includes a head 180. Each of the pins 176 can be slid through a hole 182 in the aft isolation ring 170 so that the first end 176 of each pin 174 protrudes axially beyond an upstream face 184 of the aft isolation ring 170, as shown in FIG. 18. In one embodiment, the holes 182 can be countersunk so that the head 180 of each pin 174 is recessed from a downstream face 186 of the aft isolation ring 170. Like the first plurality of pins 172, the quantity and arrangement of the second plurality of pins 174 can be optimized as needed.

The second plurality of pins can be provided in a recessed portion 188 of the downstream face 186 of the aft isolation ring 170. A locking plate 190 can be positioned in the recessed portion 188 so as to be substantially flush with at least a portion of the downstream face 186 of the aft isolation ring 170. The locking plate 190 can bear against the heads 180 of the second plurality of pins 174 so that the heads 180 are clamped between the locking plate 190 and the aft isolation ring 170, thereby holding the pins 174 in place. The locking plate 190 can be attached to the aft isolation ring 170 by brazing, welding, mechanical engagement, and/or fasteners, just to name a few possibilities. In one embodiment, the locking plate 190 can be secured to the aft isolation ring 170 by a plurality of bolts 191. In such case, the aft isolation ring 170 can provided a plurality of holes 193, which can be threaded, to receive and engage the bolts 191.

The forward and aft spans 170, 171 of the ring segment 121 can include a series of cutouts 192 to receive the pins 172, 174 so as to operatively connect the ring segment 121 and the isolation rings 168, 170. The previous discussion of cutouts 94 in connection with embodiments of the invention shown in FIGS. 2-13 applies equally to cutouts 192 and is incorporated by reference. Any suitable wear resistant coating (not shown) can be applied to the cutouts 192 and various contacting surfaces to minimize wear due to vibration, among other things.

The ring seal system can further provide a seal plate 194. The seal plate 194 can be a thin metal plate. A portion of the seal plate 194 can be received in a recess 196 in the forward isolation ring 168; another portion of the seal plate 194 can be received in a recess 198 in the forward span 169 of the ring seal 120. The seal plate 194 can minimize the leakage of coolant from the high pressure cold side 199 to the relatively lower pressure hot gas path 147. A similar seal plate may not be necessary between the aft span 171 and the aft isolation ring 170 because, as discussed earlier, the ring seal 120 will be pushed axially downstream due to differences in pressure. Thus, the aft span 171 can engage the aft isolation ring 170 so that coolant leakage is minimized.

Figure 19:
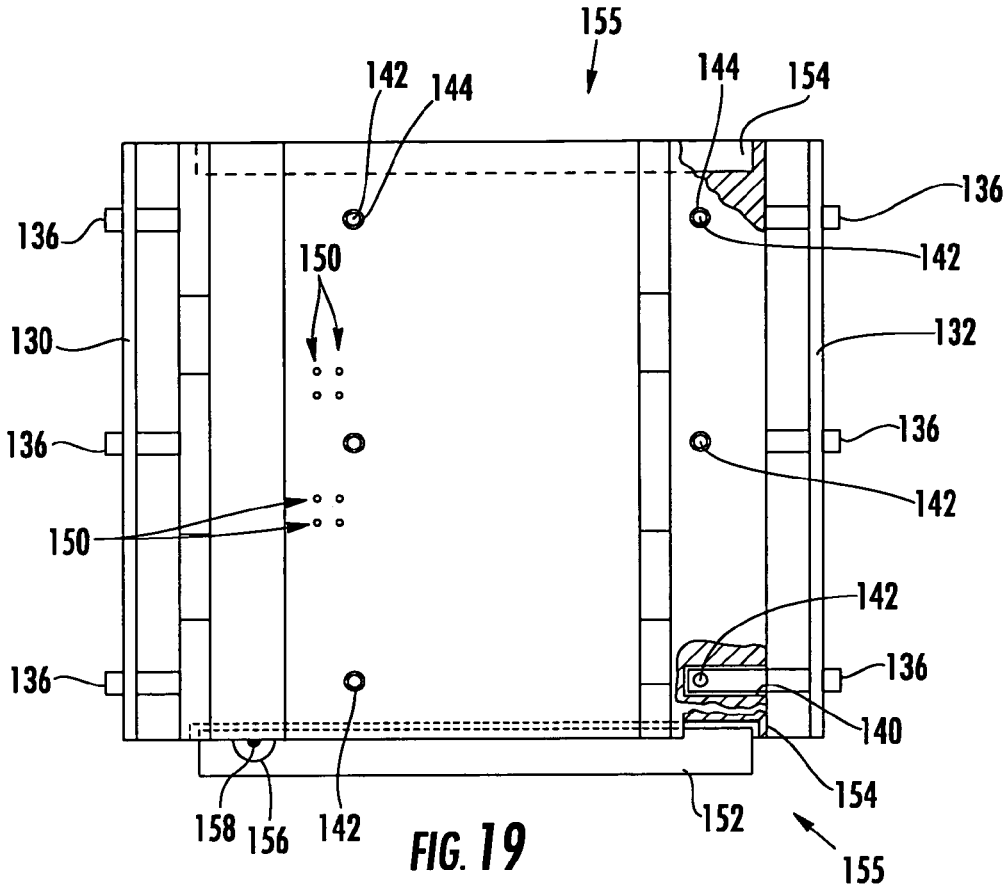
FIG. 19 is a top plan view of the ring seal according to aspects of the invention.

As shown in FIG. 19, there can be a plurality of coolant supply passages 150 extending substantially radially through the ring seal 120 and in fluid communication with the space 146 between the ring seal 120 and the heat shield 122. It will be noted that the coolant supply passages 150 can be provided closer to the axial upstream face 124 of the ring seal 120. For reasons discussed earlier, it is preferred if coolant at high pressure (relative to the hot gases 147) is initially delivered to the axial upstream region of the ring seal 120 region.

Figure 20:
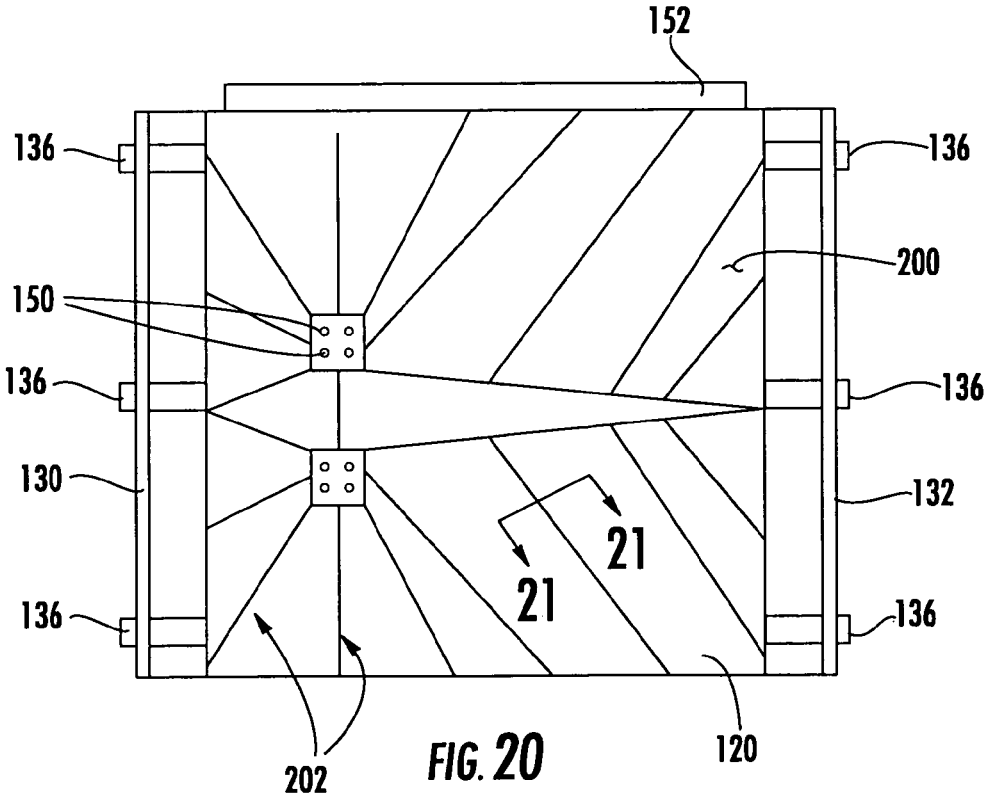
FIG. 20 is a bottom plan view of the ring seal according to aspects of the invention.
Figure 21:
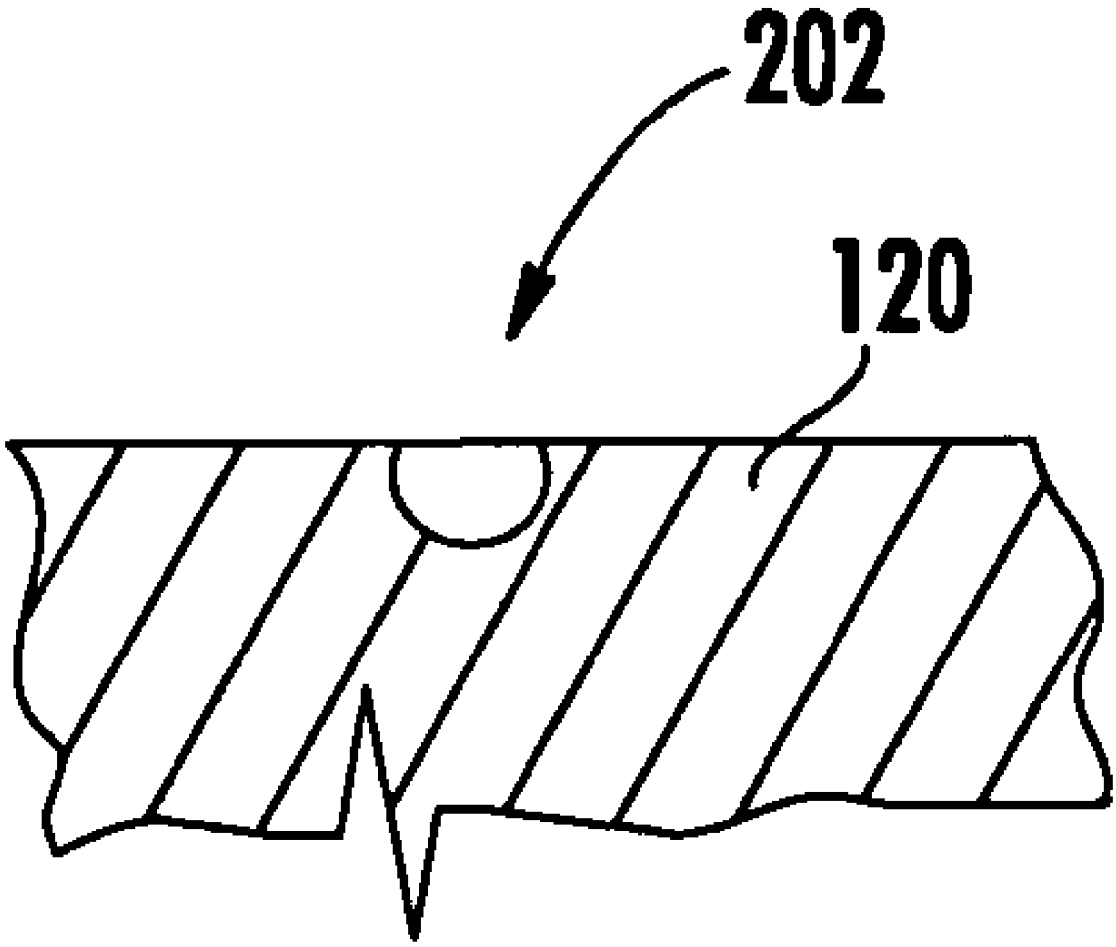
FIG. 21 is a cross-sectional view of the ring seal according to aspects of the invention, viewed along line 21-21 in FIG. 20, showing a cooling channel in the inside surface of the ring seal.

Referring to FIG. 20, the radially inner side 200 of the ring seal 120 can be adapted to facilitate circulation of a coolant about a substantial portion of the radially inner side 200 of the ring seal 120. In one embodiment, the ring seal 120 can include a plurality of channels 202 formed in the radially inner surface 200. The channels 202 can be substantially semi-circular in cross-section (as shown in FIG. 21), but aspects of the invention are not limited to any specific geometry. The channels 202 can direct a coolant to coolant exit passages (not shown) provided along the heat shield 130, such as in the axial forward and aft spans 130, 132.

The foregoing description is provided in the context of various possible systems for reducing the cooling requirements of a ring seal in a turbine engine, which can improve engine performance and efficiency. It will of course be understood that the invention is not limited to the specific details described herein, which are given by way of example only, and that various modifications and alterations are possible within the scope of the invention as defined in the following claims.

What is claimed is:

1. A ring seal system comprising:

a vane carrier having an inner peripheral surface;

a forward isolation ring and an aft isolation ring spaced axially downstream of the forward isolation ring, wherein the isolation rings are attached to the vane carrier such that the isolation rings extend substantially circumferentially about and substantially radially inward from the inner peripheral surface of the vane carrier; and a ceramic ring seal enclosed within the vane carrier, wherein the ring seal is operatively connected to the forward and aft isolation rings by a plurality of elongated fasteners, whereby differential thermal growth between the isolation rings and the ring seal is permitted, wherein the ring seal includes a forward span, an aft span and an axial extension connecting therebewteen, wherein the aft span of the ring seal is adapted to substantially matingly engage the aft isolation ring, wherein at least a portion of the aft span and the aft isolation ring are coated with a wear resistant material.

2. The system of claim 1 wherein the ring seal includes a gas path face, wherein at least a portion of the gas path face is coated with a thermal insulating material.

3. The system of claim 1 wherein the ring seal includes a forward span, an aft span and an axial extension connecting therebewteen.

4. The system of claim 3 wherein the elongated fasteners are pins, wherein a plurality of pins are affixed to the forward isolation ring and extend substantially axially therefrom, wherein the forward span of the ring seal includes a plurality of cutouts, wherein each cutout receives a respective one of the plurality of pins.

5. The system of claim 3 wherein the ring seal is positioned such that the forward span is located axially downstream of at least a portion of the forward isolation ring, and such that the aft span is located axially upstream of the aft isolation ring.

6. The system of claim 5 wherein an angle between the aft span and the axial extension is less than 90 degrees.

7. The system of claim 5 wherein the elongated fasteners are pins, wherein a plurality of pins are removably attached to the aft isolation ring and extend substantially axially therefrom, wherein the aft span of the ring seal includes a plurality of cutouts, wherein each cutout receives a respective one of the plurality of pins.

8. The system of claim 3 wherein the ring seal is positioned such that the forward span is located axially downstream of at least a portion of the forward isolation ring, and such that the aft span is located axially downstream of at least a portion of the aft isolation ring.

9. The system of claim 8 wherein the angle between the aft span and the axial extension is about 90 degrees.

10. The system of claim 8 wherein the elongated fasteners are pins, wherein a plurality of pins are removably attached to the aft isolation ring and extend substantially axially therefrom, wherein the aft span of the ring seal includes a plurality of cutouts, wherein each cutout receives a respective one of the plurality of pins.

11. A ring seal system comprising:

a metal ring seal having an axial upstream face and an axial downstream face; and a ceramic heat shield having a forward span and an aft span, wherein the forward span is operatively connected to the axial upstream face of the ring seal by a plurality of fasteners, and wherein the aft span is operatively connected to the axial downstream face of the ring seal by a plurality of fasteners, such that the heat shield is spaced from the ring seal, whereby a space is defined therebetween wherein a plurality of cooling supply holes extend through the ring seal so as to be in fluid communication with the space, wherein the cooling supply holes are located closer to the axial upstream face of the ring seal than the axial downstream face, wherein the aft span of the heat shield includes at least one exit passage extending therethrough and in fluid communication with the space between the ring seal and the heat shield.

12. The system of claim 11 wherein the heat shield is positioned such that the forward span is axially upstream of the axial upstream face of the ring seal and such that the aft span is axially downstream of the axial downstream face.

13. The system of claim 11 wherein the fasteners extend through cutouts provided in the heat shield and into engagement with the ring seal.

14. The system of claim 11 further including a side seal, wherein the ring segment has opposite circumferential ends, wherein the ring seal includes a recess in one of the circumferential ends, and wherein a portion of the side seal is received within the recess.

15. The system of claim 11 further including at least one seal plate, wherein a first gap is defined between the axial upstream face of the ring seal and the forward span of the heat shield, and a second gap is defined between the axial downstream face of the ring seal and the aft span of the heat shield, wherein the seal plate is attached to the ring seal so as to at least partially obstruct fluid communication with the space through the gaps, whereby fluid leakage through the gaps is minimized.

16. The system of claim 11 wherein the ring seal includes a radially inner side, wherein the radially inner side includes a plurality of cooling channels.

* * * * *